US009532683B2

(12) United States Patent
Hagleitner

(10) Patent No.: US 9,532,683 B2
(45) Date of Patent: Jan. 3, 2017

(54) FOAMING SOAP DISPENSER

(76) Inventor: Hans-Georg Hagleitner, Zell am See (AT)

( * ) Notice: Subject to any disclaimer, the term of this patent is extended or adjusted under 35 U.S.C. 154(b) by 848 days.

(21) Appl. No.: 13/274,668

(22) Filed: Oct. 17, 2011

(65) Prior Publication Data

US 2012/0048891 A1 Mar. 1, 2012

Related U.S. Application Data

(63) Continuation of application No. PCT/AT2009/000149, filed on Apr. 15, 2009.

(51) Int. Cl.

| | |
|---|---|
| ***B67D 1/00*** | (2006.01) |
| ***B67D 7/14*** | (2010.01) |
| ***B67D 7/78*** | (2010.01) |
| ***B67D 7/84*** | (2010.01) |
| ***A47K 5/16*** | (2006.01) |

(52) U.S. Cl.
CPC ..... *A47K 5/16* (2013.01)

(58) Field of Classification Search
USPC ..... 222/52, 63, 135, 138–142, 145.6, 145.7,222/173, 181.2, 181.3, 190, 214
See application file for complete search history.

(56) References Cited

U.S. PATENT DOCUMENTS

| | | | | |
|---|---|---|---|---|
| 4,601,645 | A * | 7/1986 | Schmitkons | 418/9 |
| 5,906,299 | A | 5/1999 | Hagleitner | |
| 7,191,920 | B2 * | 3/2007 | Boll et al. | 222/333 |
| 2003/0006246 | A1 * | 1/2003 | Studer et al. | 222/52 |
| 2005/0139612 | A1 | 6/2005 | Matthews et al. | |
| 2005/0271599 | A1 * | 12/2005 | Matthews et al. | 424/47 |
| 2006/0011655 | A1 | 1/2006 | Ophardt | |
| 2007/0040048 | A1 * | 2/2007 | Poizot | 239/343 |

FOREIGN PATENT DOCUMENTS

| | | | |
|---|---|---|---|
| WO | 96/29921 | A1 | 10/1996 |
| WO | 2005/107699 | A1 | 11/2005 |

OTHER PUBLICATIONS

International Search Report of PCT/AT2009/000149, Dated Dec. 21, 2009.

* cited by examiner

*Primary Examiner* — Kevin P Shaver
*Assistant Examiner* — Vishal Pancholi
(74) *Attorney, Agent, or Firm* — Laurence A. Greenberg; Werner H. Stemer; Ralph E. Locher

(57) ABSTRACT

A foaming soap dispenser includes a housing having a discharge opening at the bottom, a receptacle in which a liquid soap reservoir can be replaceably inserted and a soap container beneath the reservoir. A peristaltic or squeezed-tube pump for the soap and a diaphragm pump for feeding foaming air to a foaming device disposed close to the discharge opening, can be driven separately electrically.

7 Claims, 3 Drawing Sheets

FOAMING SOAP DISPENSER

CROSS-REFERENCE TO RELATED APPLICATION

This is a continuation, under 35 U.S.C. §120, of copending International Application No. PCT/AT2009/000149, filed Apr. 15, 2009, which designated the United States; the prior application is herewith incorporated by reference in its entirety.

BACKGROUND OF THE INVENTION

Field of the Invention

The invention relates to a foaming soap dispenser having a housing with a dispensing opening on the underside, a receptacle inside the housing, a liquid soap reservoir to be exchangeably inserted into the receptacle, an intermediate container underneath the reservoir, a metering pump for supplying the soap, an air pump for supplying foaming air, and a foaming device close to the dispensing opening.

Foaming soap dispensers having separate pumps for air and soap are already known, for example from International Publication No. WO 96/29921, in which two piston pumps can be actuated together through the use of an actuating element which is formed by a pivotable lid of the housing.

For the sake of simplicity, reference is made herein and in the appended claims to "foaming soap" and "soap," which are understood to include all foamable substances for cleaning, disinfection, care, etc.

SUMMARY OF THE INVENTION

It is accordingly an object of the invention to provide a foaming soap dispenser, which overcomes the hereinaforementioned disadvantages of the heretofore-known devices of this general type and which can be actuated in a contactless manner.

With the foregoing and other objects in view there is provided, in accordance with the invention, a foaming soap dispenser, comprising a housing having an underside accommodating a dispensing opening, a receptacle disposed inside the housing, a liquid soap reservoir exchangeably inserted into the receptacle, a soap container disposed underneath the reservoir, a peristaltic metering pump for supplying soap, a diaphragm air pump for supplying foaming air, and a foaming device in vicinity of the dispensing opening.

A diaphragm pump is a machine for delivering liquids or gases. Its operational principle is similar to that of a piston pump, but the medium to be delivered is separated from the drive by a diaphragm. The separating diaphragm thus shields the mechanical part of the drive from harmful effects of the delivery medium. The drive is effected, for example, by an electric motor through the use of a connecting rod fastened to the diaphragm. Such diaphragm pumps are obtainable in a small size as so-called micropumps, which are disposed, for example, in a compact L-shaped housing, in which an outlet and an inlet are oriented parallel to one another and to a motor axis.

A peristaltic or squeezed-tube pump is more suitable for viscous substances, such as soap, for example, since a peristaltic pump is insensitive to air inclusions and ensures that the appropriate portion of soap is dispensed. A pump rotor carries at least two rollers, which protrude from the circumference or periphery and squeeze a tube which is curved around the circumference of the rotor. The drive is in particular likewise effected by an electric motor.

In order to provide contactless dispensing, the foaming soap dispenser is preferably provided with a sensor device in the vicinity of the dispensing opening. The sensor device is used to detect a hand held under the opening and to put the two pumps for generating a portion of foamed soap into operation.

A preferred embodiment provides that the container, the two pumps including the electric motors, the foaming device and preferably a controller are combined in a working block which is provided as a compact component in the lower region of the dispenser housing. The working block includes a molded part which is preferably produced from plastics material and has an upper and a lower recess. The soap container is provided in the upper recess and the two pumps and the foaming device are inserted into the lower recess. In this case, a preferred embodiment provides that the foaming device is held in the working block through the use of a clip or similar plug-in configuration in such a way that it can be exchanged easily in order, for instance, to ensure that foaming devices having different screen inserts or foaming bodies can be used as required.

In a further preferred embodiment, it is provided that the ratio of the delivery volumes of air and soap can be set through the use of the controller by changing the speed of one of the two electric motors. For this reason, DC motors are used in particular, having a speed and a delivery amount connected directly therewith which is directly proportional to the motor voltage.

Changing the foam consistency makes it possible, on one hand, to set a fixed minimum dispensing amount, for example of a disinfecting cleaning fluid or, on the other hand, to make available, in the event of heavy soiling, a larger amount or, in the event of light soiling, a smaller amount of soap foam, and in the process to leave the dispensed portion and dispensing time virtually unchanged in each case.

In a preferred embodiment, it is therefore provided that the volume ratio can be set by changing the speed of the motor for the soap pump. The speed of the motor for the air pump thus remains constant in this embodiment. Preferred volume ratios of air to soap are between 50:1—fairly dry, ultrafine-pored foam—to 50:2 (=25:1), i.e. with twice the proportion of soap, as a result of which the foam is fairly fluid. Preferred dispensing amounts of foamed cleaning fluid are from approximately 0.3 ml for 1 second and an approximate volume ratio of 50:1—fairly dry foam—to approximately 0.9 ml for 1.5 seconds and an approximate volume ratio of 50:2—very moist foam. The delivery volume of the air pump can preferably be 15 ml/sec.

Other features which are considered as characteristic for the invention are set forth in the appended claims.

Although the invention is illustrated and described herein as embodied in a foaming soap dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
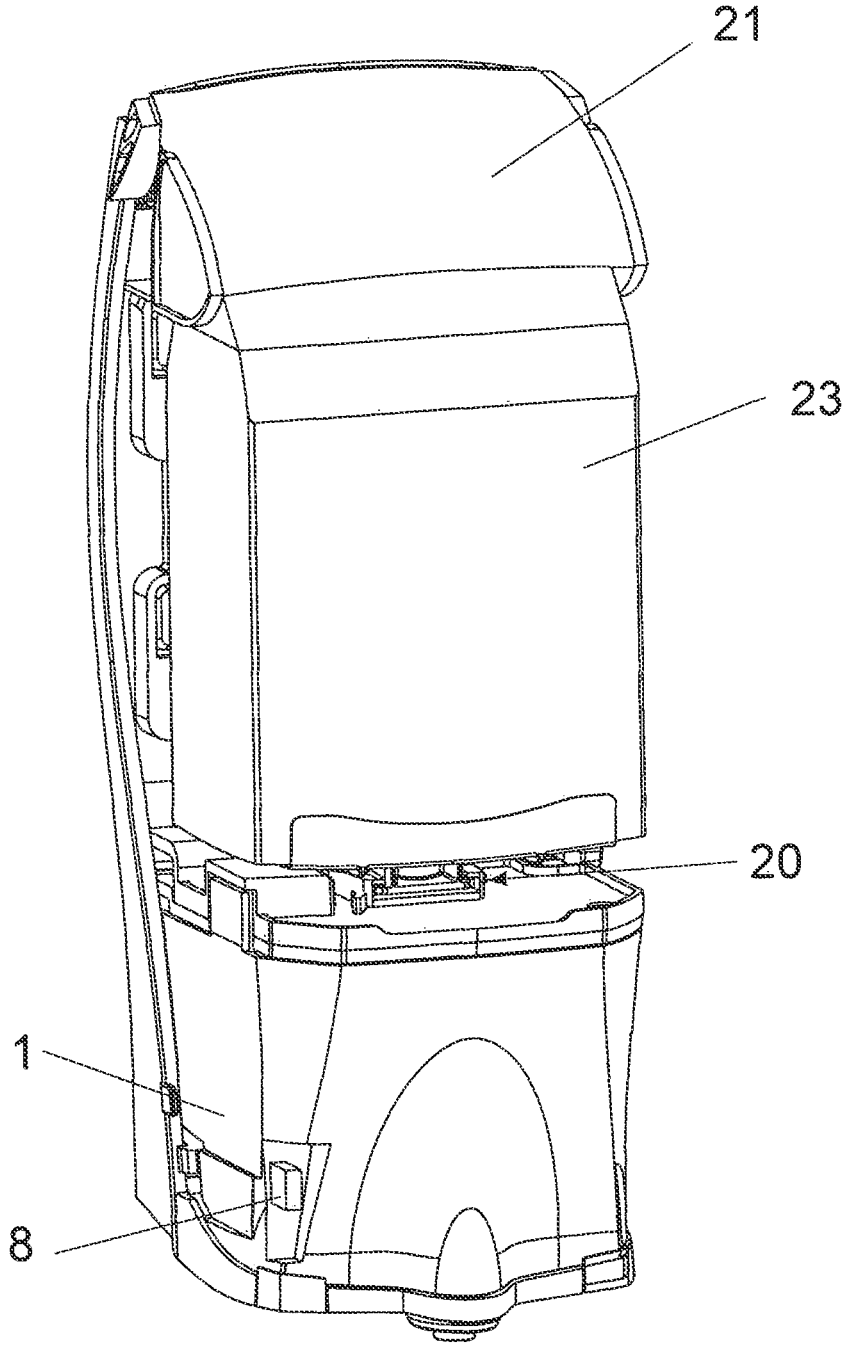
FIG. 1 is a diagrammatic, front-perspective view of a foaming soap dispenser according to the invention with a cover removed.
Figure 5:
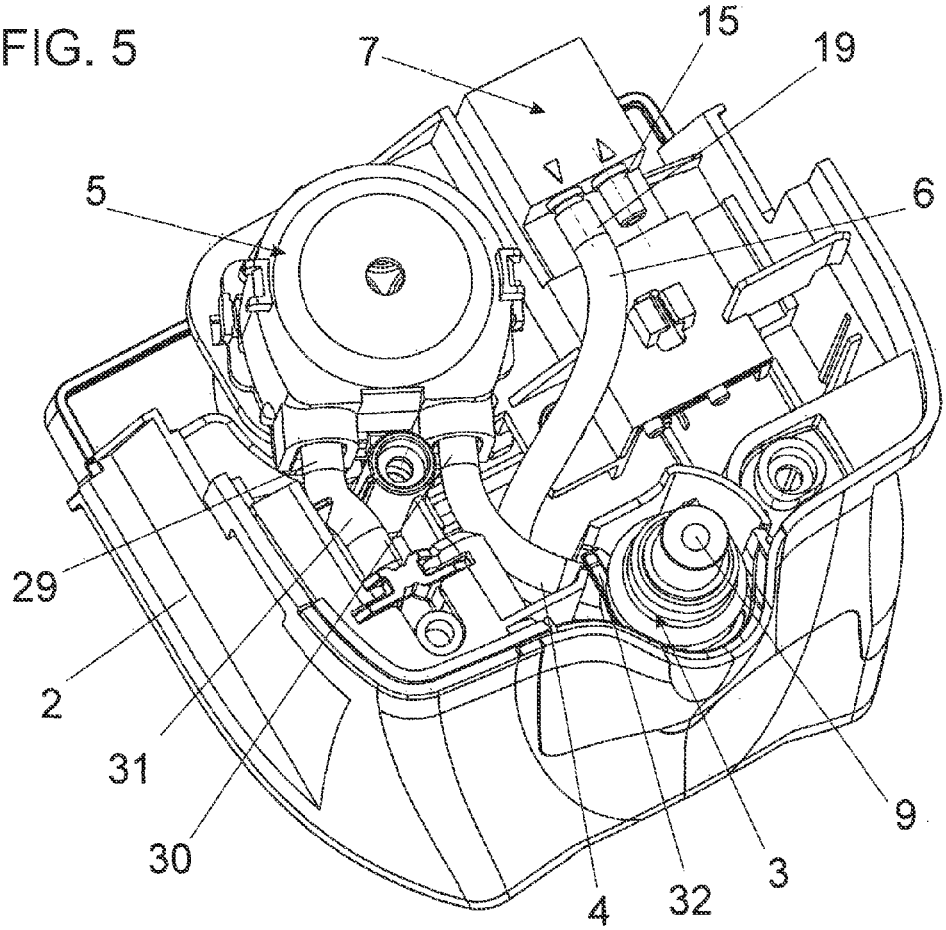
FIG. 5 is a bottom-perspective view of the working block.

Referring now to the figures of the drawings in detail and first, particularly, to FIG. 1 thereof, there is seen a foaming soap dispenser with a housing 21 having a cover, in which it is possible to insert a reservoir 23 in an exchangeable manner into a fluid-tight receptacle 20 in an upper region of the housing. A dispensing opening 9, which is shown in FIG. 5, is disposed at the underside of the housing 21. All of the elements necessary for operation are combined in a compact working block 1 provided in a lower region. As is illustrated schematically in FIG. 2, the working block 1 contains a soap container 2, from which a soap pump 5, which is configured as a peristaltic or squeezed-tube pump, draws soap and supplies it through a soap line 4 to a foaming device 3.

The working block 1 furthermore contains an air pump 7, which is configured as a diaphragm pump, that draws in air and supplies it through an air line 6 likewise to the foaming device 3. An actuating device 8 makes it possible to change various parameters, such as a size of a foam portion 10, an air-soap ratio, etc.

Figure 3:
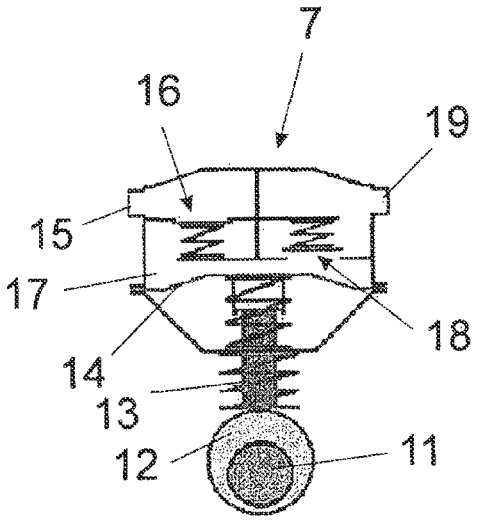
FIGS. 3 and 4 are respective sectional views of a diaphragm pump and a peristaltic pump.

The pumps 5, 7 each have an electric drive, in particular a DC motor, the speed of which is directly proportional to the motor voltage. As is shown in FIG. 3, the pump 7 has an eccentric disk 12 which is fastened to a motor output shaft 11 and moves a spring-loaded reciprocating piston 13 back and forth. The reciprocating piston 13 projects into a pump housing and is connected to a diaphragm 14 which is braced between two housing parts and bounds a pump chamber 17. The pump chamber 17 has an inlet 15 and an outlet 19, to each of which a respective nonreturn valve 16 and 18 is assigned. FIG. 3 shows a pressing-out or pressure position of the air pump 7, in which the inlet-side valve 16 is closed and the outlet-side valve 18 is open.

Figure 4:
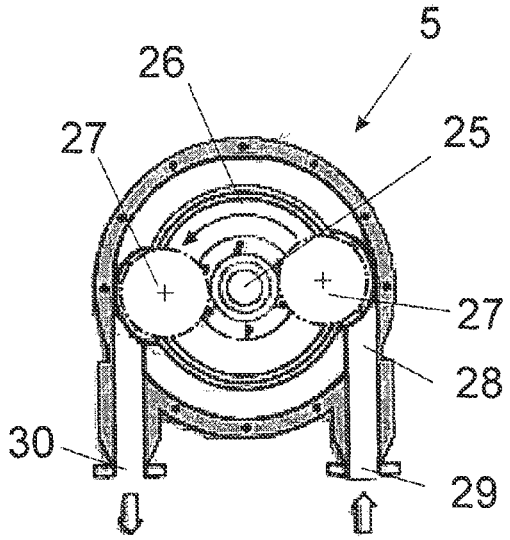

The working block 1 furthermore contains the peristaltic soap pump 5, which is illustrated diagrammatically in FIG. 4. The pump includes an output shaft 25, a rotor 26 fastened to the output shaft 25 and two or three rollers or rolling bodies 27 on the rotor 26 which protrude around the circumference and are mounted in a rotatable manner. A tube 28, which is disposed approximately in a semicircle around the rotor 26, is squeezed by the rollers 27 as the rotor 26 rotates in such a way that soap contained in the tube 28 is delivered from an inlet 29 to an outlet 30. A peristaltic pump 5 of this kind is self-priming and its delivery action is not adversely affected by included air so that it is readily suitable for the uniform metering of soap portions.

FIG. 5 shows a view obliquely from below into the working block 1. The working block has a molded part produced from plastics material. The soap container 2, which is provided on the top side of the molded part, is closed by a lid that supports the receptacle 20. Recesses for the air pump 7, the soap pump 5, the foaming device 3 and a non-illustrated controller board, are provided on the underside. Respective tubes lead to the foaming device 3 from the outlet 19 of the air pump 7 and the outlet 30 of the soap pump 5, namely an air duct having reference numeral 6 and a soap duct having reference numeral 4. The inlet 29 of the soap pump 5 is connected by a further tube 31 to the top-side soap container 2. The foaming device 3 is provided in an exchangeable manner on the working block 1 by way of a U-shaped stirrup 32 and has the dispensing opening 9 at the underside of the housing.

The amount of air delivered is kept constant, that is to say that the speed of the air pump 7 is not changed. The soap proportion, which affects the consistency of the foam, can be varied by changing the speed of the soap pump 5.

Figure 2:
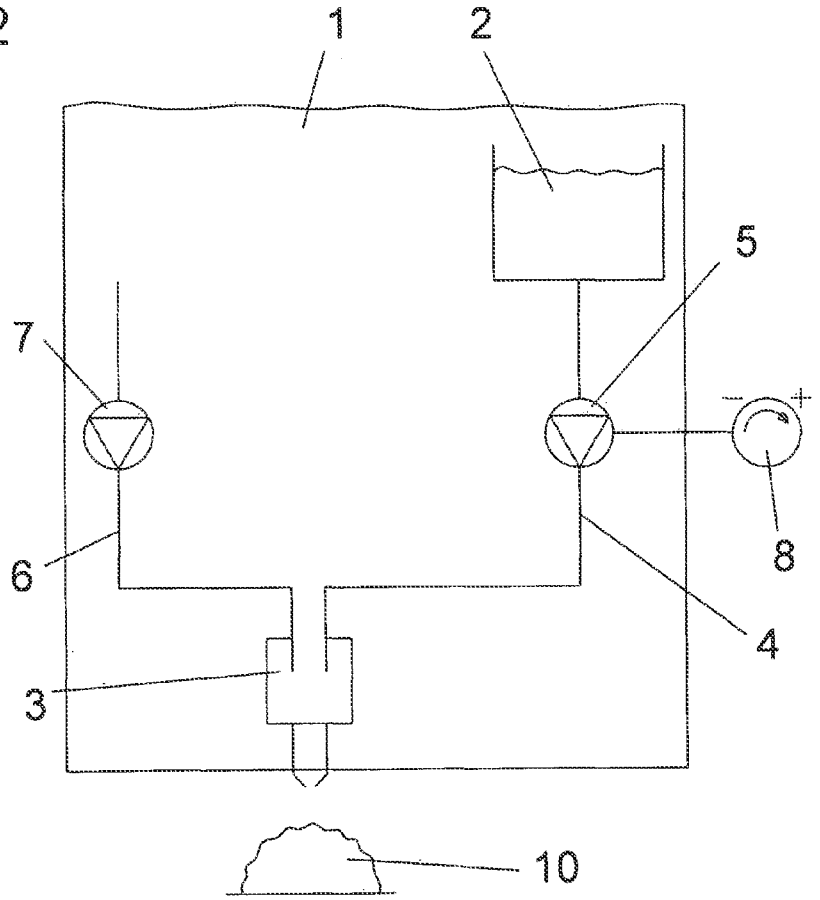
FIG. 2 is a schematic operational illustration of a working block according to the invention.

FIG. 2 shows the speed regulation of the soap pump 5 as being from outside the housing 1. However, a rotary knob of the actuating device 8, which is in the form of a potentiometer, can also be disposed inside the housing, as is indicated in FIG. 1, in which case a housing lid, which may be locked, has to be opened. This embodiment allows only authorized users, for example service staff, to change the foaming soap consistency.

Figure 6:
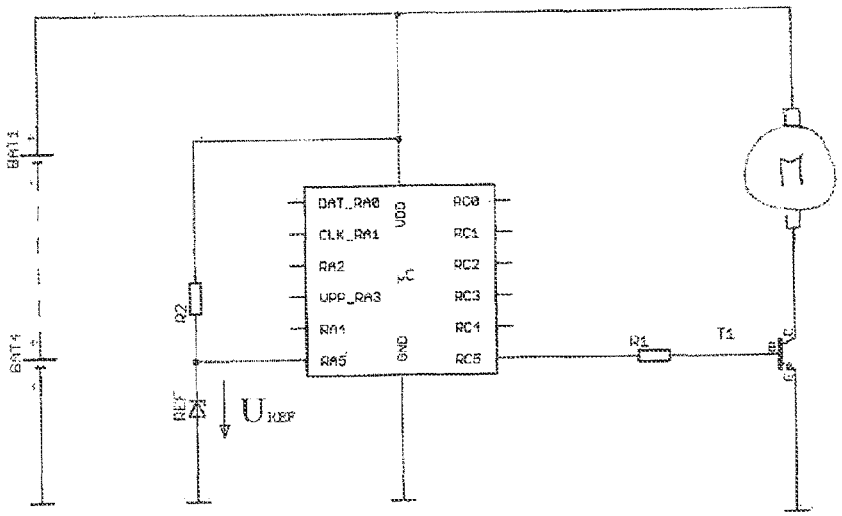
FIG. 6 is a schematic diagram of a circuit for stabilizing voltage output by batteries.

The dispenser may be connected to the local power supply or have an internal power source. In the case of an internal power source, for example four alkaline batteries, the battery voltage drops from 6.4 V to 4 V with continuing use. Thus, an internal power source is therefore assigned in particular voltage stabilization through the use of pulse-width modulation, as shown in FIG. 6, and use is made of DC motors, the motor voltage of which is located close to the lower limit of the battery voltage so that the specified speeds of the two pumps 5, 7 can be maintained almost until the internal power source is used up. As is shown in FIG. 6, a controller μC compares a supply voltage to a reference voltage $U_{REF}$ of a reference diode, which may also be an internal reference, and regulates the pulse-width modulation (PWM) of a motor M to 4 V. An output transistor T1 serves as a driver in order to achieve the necessary current for the motor.

The invention claimed is:

1. A foaming soap dispenser, comprising:

a housing having an underside accommodating a dispensing opening;

a receptacle disposed inside said housing;

a liquid soap reservoir exchangeably inserted into said receptacle;

a soap container disposed underneath and in communication with said reservoir;

a foaming device in vicinity of said dispensing opening;

a peristaltic metering pump connected between said soap container and said foaming device for supplying a volume of soap;

a diaphragm air pump connected to said foaming device for supplying a volume of foaming air;

electric motors each being associated with a respective one of said pumps and configured to be driven separately; and a controller controlling a ratio of delivery of said volume of soap and said volume of foaming air.

2. The foaming soap dispenser according to claim 1, which further comprises a sensor disposed in vicinity of said dispensing opening for activating said pumps.

3. The foaming soap dispenser according to claim 1, which further comprises a working block provided as a compact component in a lower region of said housing, said soap container, said pumps, said electric motors and said foaming device being combined in said working block.

4. The foaming soap dispenser according to claim 3, which wherein said controller is disposed in said working block.

5. The foaming soap dispenser according to claim 1, wherein said controller sets said ratio by changing a speed of one of said electric motors.

6. The foaming soap dispenser according to claim 5, wherein said volume ratio is set by changing the speed of said motor for said soap pump.

7. The foaming soap dispenser according to claim 5, wherein said volume ratio of air to soap can be changed between 25:1 and 50:1.

* * * * *